US009442407B2

(12) United States Patent
Sakamoto

(10) Patent No.: US 9,442,407 B2
(45) Date of Patent: Sep. 13, 2016

(54) APPARATUS, CONTROLLER, AND METHOD OF FORMING MULTICOLOR TONER IMAGE

(71) Applicant: Junshin Sakamoto, Kanagawa (JP)

(72) Inventor: Junshin Sakamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/935,629

(22) Filed: Nov. 9, 2015

(65) Prior Publication Data

US 2016/0139528 A1 May 19, 2016

(30) Foreign Application Priority Data

Nov. 14, 2014 (JP) ..... 2014-231313

(51) Int. Cl.
*G03G 15/16* (2006.01)
*G03G 15/01* (2006.01)
*G03G 15/00* (2006.01)

(52) U.S. Cl.
CPC ..... *G03G 15/0152* (2013.01); *G03G 15/5058* (2013.01); *G03G 2215/00067* (2013.01); *G03G 2215/0158* (2013.01)

(58) Field of Classification Search
CPC ..... G03G 2215/0161; G03G 15/5054
See application file for complete search history.

(56) References Cited

U.S. PATENT DOCUMENTS 5,600,421 A * 2/1997 Takekoshi ..... G03G 15/0131 399/299
6,434,348 B1 * 8/2002 Tomizawa ..... G03G 15/1675 399/49
7,764,897 B2 * 7/2010 Takezawa ..... G03G 15/0194 399/301
8,139,968 B2 * 3/2012 Katoh ..... G03G 15/0131 399/154
8,521,046 B2 * 8/2013 Sugiyama ..... G03G 15/0131 399/49
8,670,684 B2 * 3/2014 Isoda ..... G03G 15/5058 399/49
2005/0105926 A1 5/2005 Akatsu et al.

(Continued)

FOREIGN PATENT DOCUMENTS

JP 2005-084207 3/2005
JP 2006-047605 2/2006

(Continued)

*Primary Examiner* — Minh Phan
*Assistant Examiner* — Leon W Rhodes, Jr.
(74) *Attorney, Agent, or Firm* — Oblon, McClelland, Maier & Neustadt, L.L.P.

(57) ABSTRACT

An image forming apparatus includes a transfer condition setting device to set a patch image transfer condition under which multiple patch images of respective component colors are transferred from an image bearer onto a recording medium conveyor. The transfer condition setting device sets a prescribed transfer condition that decreases a difference in transfer efficiency of toner between the respective component colors when the multiple patch images of respective component colors are transferred onto the recording medium conveyor below a difference in transfer efficiency of toner between the multiple component colors caused when transferred under the same transfer condition as a multicolor toner image is transferred onto a recording medium. A correcting device corrects an image forming condition to reduce an amount of misalignment caused in the multiple component colors of the multicolor toner image based on times of outputs from a patch image position sensor.

18 Claims, 8 Drawing Sheets

(56) References Cited

U.S. PATENT DOCUMENTS

| | | | | |
|---|---|---|---|---|
| 2006/0029407 | A1 | 2/2006 | Sakamoto | |
| 2007/0217831 | A1* | 9/2007 | Maeda | G03G 15/0194 399/301 |
| 2011/0097096 | A1* | 4/2011 | Sueoka | G03G 15/1605 399/49 |
| 2011/0194877 | A1* | 8/2011 | Yoshioka | G03G 15/0131 399/299 |
| 2012/0045234 | A1* | 2/2012 | Suzuki | G03G 15/5058 399/49 |
| 2012/0269526 | A1* | 10/2012 | Lee | G03G 15/0131 399/49 |
| 2012/0321356 | A1 | 12/2012 | Sakamoto | |

FOREIGN PATENT DOCUMENTS

| | | | |
|---|---|---|---|
| JP | 2006106206 | A * | 4/2006 |
| JP | 2010-128070 | | 6/2010 |
| JP | 2011-154184 | | 8/2011 |
| JP | 2013-020234 | | 1/2013 |
| JP | 2014-178385 | | 9/2014 |

* cited by examiner

APPARATUS, CONTROLLER, AND METHOD OF FORMING MULTICOLOR TONER IMAGE

CROSS-REFERENCE TO RELATED APPLICATION

This patent application is based on and claims priority pursuant to 35 U.S.C. §119(a) to Japanese Patent Application No. 2014-231313, filed on Nov. 14, 2014, in the Japan Patent Office, the entire disclosure of which is hereby incorporated by reference herein.

BACKGROUND

1. Technical Field

Embodiments of the present invention relate to an image forming apparatus, a controller, and a method of forming a multicolor toner image.

2. Related Art

In a known image forming apparatus, a full-color toner image is formed by superimposing toner images of multiple component colors on an image bear and transferring the superimposed toner images from the image bear onto a recording sheet in a transfer unit. At that time, relative misalignment of one or more of the toner images of the multiple component colors is generally either corrected or reduced.

That is, for example, multiple linear patch images are formed and transferred onto a secondary transfer roller, which generally holds and conveys the recording sheet in a prescribed direction as a recording sheet conveyor, and multiple positions of the linear patch images are detected on the secondary transfer roller. The known image forming apparatus then corrects relative misalignment of one or more of the multicolor toner image based on a result of detection of the respective positions of multiple linear patch images. That is, in the known image forming apparatus, the patch images are formed on multiple photoconductive drums for respective component colors and are transferred onto an intermediate transfer belt in respective primary transfer nips formed therebetween, in which the multiple photoconductive drums and the intermediate transfer belt press against each other. Then, the patch images of respective component colors transferred onto the intermediate transfer belt are secondarily transferred onto a circumferential surface of the secondary transfer roller in a secondary transfer nip formed therebetween as a secondary transfer station, in which the intermediate transfer belt and the secondary transfer roller press against each other. Here, a secondary transfer condition, such as a secondary transfer voltage, a secondary transfer current, etc., under which a secondary transfer process is executed in the secondary transfer nip, is conventionally equalized to a transfer condition under which a full-color toner image obtained by superimposing toner images of multiple component colors (hereafter simply referred to as a full-color toner image) is secondarily transferred. Subsequently, an optical reflection type sensor detects the multiple patch images of respective component colors borne on the secondary transfer roller.

Since the reflection type sensor generally includes a light emitting element and a light receiving element, a light beam emitted from the light emitting element is reflected by a surface of the secondary transfer roller and reaches the light receiving element ultimately. When the respective edges of the patch images formed and borne on the secondary transfer roller are detected, an amount of light received by the light receiving element changes. Specifically, the reflection type sensor outputs a detection signal having a rising portion and/or a falling portion in a prescribed waveform thereof in accordance with the amount of light received by the light receiving element. The outputted detection signal is then compared with a prescribed threshold, and prescribed pulses are outputted as patch image detected time indicating pulses in accordance with comparison result for the multiple component colors. A position of each of the patch images of the respective component colors is detected (i.e., identified) based on a time when the reflection type sensor detects and outputs the patch image detected time indicating pulse. Based on a result of such positional detection of each of the patch images of the respective component colors, an image forming condition, such as an exposing time, a driving speed profile, etc., is corrected (i.e., adjusted) to reduce relative misalignment of one or more toner images of component color or colors in the multiple component color toner image when it occurs.

SUMMARY

Accordingly, one aspect of the present invention provides a novel image forming apparatus that includes; an image forming unit including an image bearer to form a multicolor toner image by superimposing multiple toner images of respective component colors and multiple patch images of the respective component colors on the image bearer; a transfer unit to transfer the multicolor toner image from the image bearer onto a recording medium; and a recording medium conveyor to convey and bring the recording medium in contact with the image bearer in the transfer unit. The transfer unit also transfers the multiple patch images of respective component colors from the image bearer onto the recording medium conveyor. A patch image position sensor is provided to detect positions of the multiple patch images of the respective component colors transferred from the image bearer by the transfer unit and borne on the recording medium conveyor. A correcting device is also provided to correct an image forming condition to reduce relative misalignment in the multiple toner images of the respective component colors based on times when the patch image position sensor outputs detection signals of the positions of the multiple patch images. A transfer condition setting device is provided to set a patch image transfer condition under which the multiple patch images of the respective component colors borne on the image bearer are transferred onto the recording medium conveyor. The transfer condition setting device also sets a multicolor toner image transfer condition under which the multicolor toner image borne on the image bearer is transferred onto the recording medium. The transfer condition setting device sets a prescribed patch image transfer condition that decreases a difference in transfer efficiency of toner between the respective component colors when the multiple patch images of the respective component colors are transferred onto the recording medium conveyor below a difference in transfer efficiency of toner between the respective component colors caused when the multicolor toner image is transferred from the image bearer onto the recording medium.

Another aspect of the present invention provides a novel method of forming a multicolor toner image that comprises the steps of: forming a multicolor toner image by superimposing multiple toner images of respective component colors on an image bearer with an image forming unit; conveying and bringing a recording medium in contact with the image bearer with a recording medium conveyor; and transferring the multicolor toner image from the image bearer onto the recording medium with a transfer unit. The method further comprises the steps of: forming multiple patch images of respective component colors on the image bearer with the image forming unit; and setting, with a transfer condition setting device, a patch image transfer condition that decreases a difference in transfer efficiency of toner between the respective component colors of the multiple patch images when the multiple patch images of the respective component colors are transferred onto the recording medium conveyor below a difference in transfer efficiency of toner between the respective component colors of multiple patch images caused when the multicolor toner image is transferred onto the recording medium. The method further comprises the steps of: transferring the multiple patch images of the respective component colors onto the recording medium conveyor with the transfer unit under the patch image transfer condition; detecting positions of the multiple patch images of the respective component colors transferred from the image bearer by the transfer unit and borne on the recording medium conveyor with a patch image position sensor; and correcting an image forming condition with a correcting device to reduce an amount of relative misalignment caused in the multiple toner images of the respective component colors based on times when the patch image position sensor outputs detection signals of the positions of the multiple patch images.

Yet another aspect of the present invention provides a novel controller for a multicolor toner image forming apparatus. The controller comprises a processor to generally control various devices included in the image forming apparatus via an input-output port and a memory connected to the processor. The memory stores at least one of an optimum secondary transfer current value as a patch image secondary transfer condition that maximizes secondary transfer efficiency of toner per component color when multiple patch images of respective component colors are transferred and a correction coefficient used to calculate the optimum secondary transfer current value per component color by multiplying the correction coefficient with an initially set secondary transfer current value under which a multicolor toner image is transferred from an image bearer onto a recording medium. The memory is referred to by the processor to identify and set the applicable optimum secondary transfer current value when the multiple patch images of the respective component colors are secondarily transferred.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
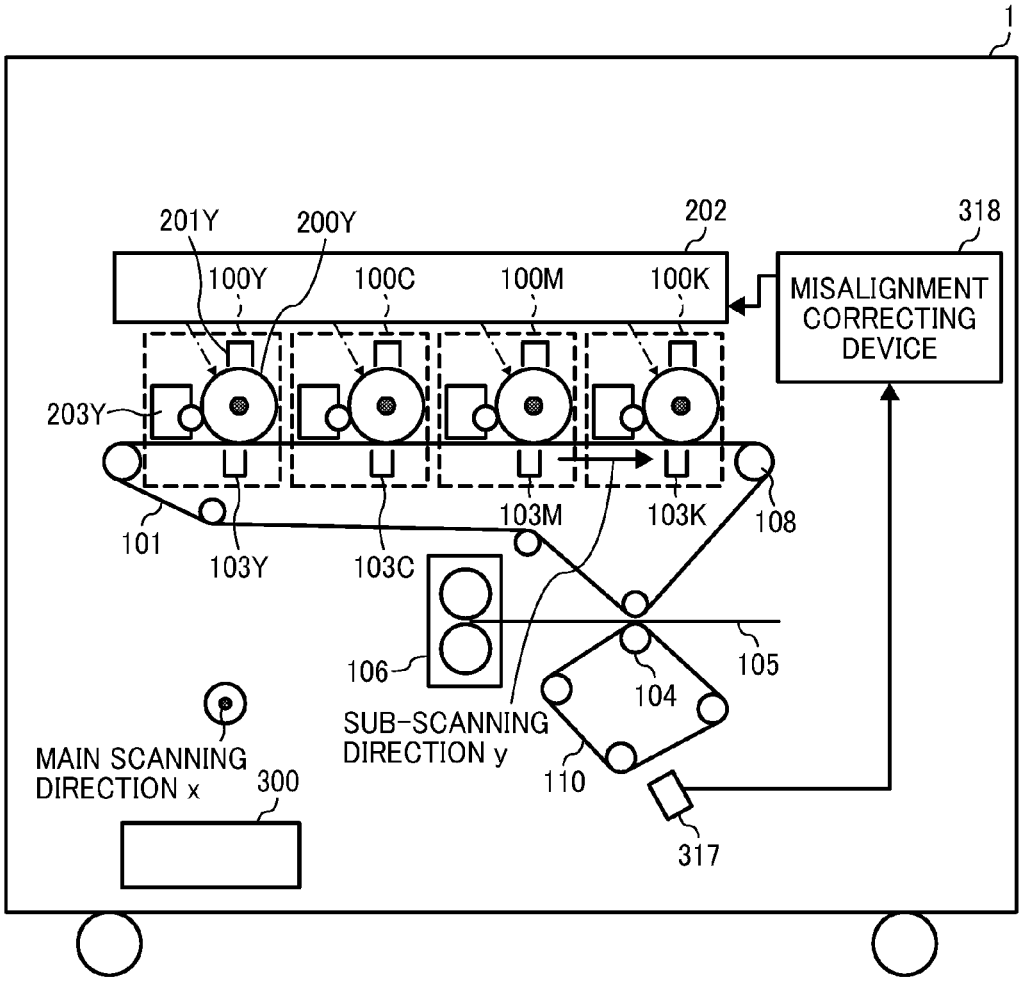
FIG. 1 is a schematic diagram illustrating an exemplary configuration of a printer according to one embodiment of the present invention.

In general, due to a difference in material or the like, toner of each of component colors has a different optimum transfer condition from each other, which maximizes transfer efficiency thereof when a toner image composed of such component color toner is transferred. Hence, when a prescribed transfer condition is commonly set to be used in a full-color toner image forming process of forming and transferring a full-color toner image from an image bearer onto a recording medium, transfer efficiency of a component color among a full-color is relatively high. By contrast, however, the transfer efficiency of the other different component color may be relatively low. Accordingly, since it has a primary correlation to the transfer efficiency, a less amount of component color toner having relatively low transfer efficiency adheres to a patch image per unit area (hereinafter simply referred to as a toner adhering amount) than an amount of the other component color toner having relatively high transfer efficiency per unit area.

Since a ratio of an area in the light receiving element, irradiated with the light beam emitted from the edges of the patch images, to the entire light receiving area of the light receiving element changes every moment, the above-described falling and rising inclinations of the output from the reflection type sensor are formed. Accordingly, when an amount of toner adhering to the patch image changes, an amount of light received by the above-described reflection type sensor correspondingly changes in accordance with the toner adhering amount. As a result, the above-described falling and/or rising inclinations of the output from the reflection type sensor also change consequently. Hence, a time period needed for the reflection type sensor to reach the prescribed threshold and thereby generate outputs for the respective component colors may vary in accordance with the amounts of toner adhering to the respective patch images of the component colors. That is, a time when the reflection type sensor detects a patch image of a prescribed component color having relatively low transfer efficiency differs from that when the reflection type sensor detects another patch image of another prescribed component color having relatively high transfer efficiency. Since the positions of the respective patch images are detected based on the times of the output from the reflection type sensor as described above, if the times of the outputs from the reflection type sensor for the component colors fluctuate, the positions of the patch images of the respective component colors cannot be accurately detected consequently. As a result, the relative misalignment occurring in the multiple patch images of the respective component colors has been insufficiently reduced conventionally.

As described below, according to one aspect of the present invention, relative misalignment in toner images of the multiple component colors, which is superimposed as a full-color toner image, can be sufficiently reduced while suppressing fluctuations of output times between outputs from a sensor which detects patch images of respective component colors as a unique advantage.

Referring now to the drawings, wherein like reference numerals designate identical or corresponding parts throughout the several views thereof, and in particular to FIG. 1 and related drawings as well, an electrophotographic printer 1 serving as an image forming apparatus (herein after simply referred to as a printer) is described according to one embodiment of the present invention. A basic configuration of the printer 1 according to one embodiment of the present invention is initially described herein below with reference to FIG. 1. The printer 1 is a tandem type color laser printer as shown there. In the tandem type color laser printer 1, multiple image forming units 100K, 100M, 100C, and 100Y are attached to a main unit thereof along an intermediate transfer belt 101 to form toner images of black (K), magenta (M), cyan (C), and yellow (Y) component colors by using corresponding coloring materials (i.e., toner particles), respectively. In the following descriptions, respective suffix letters K, M, C, and Y indicate prescribed members used to form respective images of black, magenta, cyan, and yellow component colors.

The respective image forming units 100 (100K, 100M, 100C, and 100Y) include multiple photoconductive drums 200 (200K, 200M, 200C, and 200Y) acting as photoconductors, multiple electric charging units 201 (201K, 201M, 201C, and 201Y), multiple developing units 203 (203K, 203M, 203C, and 203Y), and multiple cleaning units. As shown there, although only reference numerals 200Y, 201Y, and 203Y are added to the respective photoconductive drum, the electric charging unit, and the developing device provided in the image forming unit 100Y to simplify the description, the photoconductive drums, the electric charging units, and the developing devices respectively employed in the remaining image forming units 100K, 100M, and 100C are similarly configured and operated as those in the image forming unit 100Y.

A multi-beam type optical scanning unit 202 converts a signal transmitted thereto as color image data of each of component colors into a write signal. The optical scanning unit 202 then irradiates each of the photoconductive drums 200 with an optical imaging beam (i.e., a laser light beam) based on the write signal of each of the component colors. Each of the image forming units 100 forms a color image on each of the photoconductive drums 200 by using a series of Carlson process (i.e., an electro-photographic process), respectively. Here, each of the image forming units 100 acts as a patch image formation device that forms multiple toner image patterns (hereafter simply referred to as multiple patch images) to detect misalignment as described later in greater detail.

Respective color toner images formed in the image forming units 100 are repeatedly transferred and superimposed at the same position on an intermediate transfer belt 101 by multiple primary transfer chargers 103 (103K, 103M, 103C, and 103Y) acting as primary transfer devices to be a full-color toner image. Here, the primary transfer chargers 103 (103K, 103M, 103C, and 103Y) can be configured by multiple transfer rollers, respectively, as well. To upgrade performance of it to accommodate a recording sheet, the intermediate transfer belt 101 is generally constituted by an elastic belt (e.g., a rubber belt). The full-color toner image transferred and borne on the intermediate transfer belt 101 is transferred again onto a recording sheet 105 serving as a recording medium at once by a secondary transfer roller 104 that presses against the intermediate transfer belt 101 via a secondary transfer belt 110 to act as a recording sheet conveyor.

In an exemplary configuration as shown in FIG. 1, to detect multiple patch images borne on the secondary transfer belt 110 while upgrading accommodating performance of the recording sheet, the secondary transfer belt 110 is made of polyimide or similar material by contrast to that the intermediate transfer belt 101 employs the elastic belt (i.e., the rubber belt). When the intermediate transfer belt 101 is the elastic belt, a surface roughness thereof is relatively higher than a surface roughness of the intermediate transfer belt 101 made of polyimide or similar material. Hence, since an amount of diffusion light increases in reflection light, multiple toner image patterns (i.e., the patch images) formed on the intermediate transfer belt 101 are hardly detected by an image position detecting unit 317 acting as a pattern sensor. In view of this, the patch images are detected on the secondary transfer belt 110. Accordingly, the image position detecting unit 317 is installed at a prescribed position near the secondary transfer belt 110. That is, the multiple patch images formed on the intermediate transfer belt 101 are secondarily transferred onto the secondary transfer belt 110 by the secondary transfer roller 104, and are detected by the image position detecting unit 317 thereon. Then, writing position displacement and a positional adjustment (i.e., correction) value are respectively calculated. The multiple patch images detected on the secondary transfer belt 110 in this way are then removed therefrom by a patch image cleaner.

Meanwhile, a color toner image transferred onto a recording sheet 105 is then fixed thereto by a fixing unit 106 thereby completing a cycle of image formation. The intermediate transfer belt 101 is stretched by multiple rollers including a driving roller 108 driven and rotated by a driving device to move along beneath each of the photoconductive drums 200 in a direction as shown by an arrow in FIG. 1. Here, the moving direction of the intermediate transfer belt 101 is defined as a sub-scanning direction (y). By contrast, a widthwise direction of the recording sheet 105 (i.e., perpendicular to the sub-scanning direction) is defined as a main scanning direction (x).

A main unit controller 300 controls at least one unit or device installed in a main unit of the printer 1 and at least one member included in the unit or device that operates under control of the main unit controller 300. Now, the main unit controller 300 is described in greater detail with reference to FIG. 2.

Figure 2:
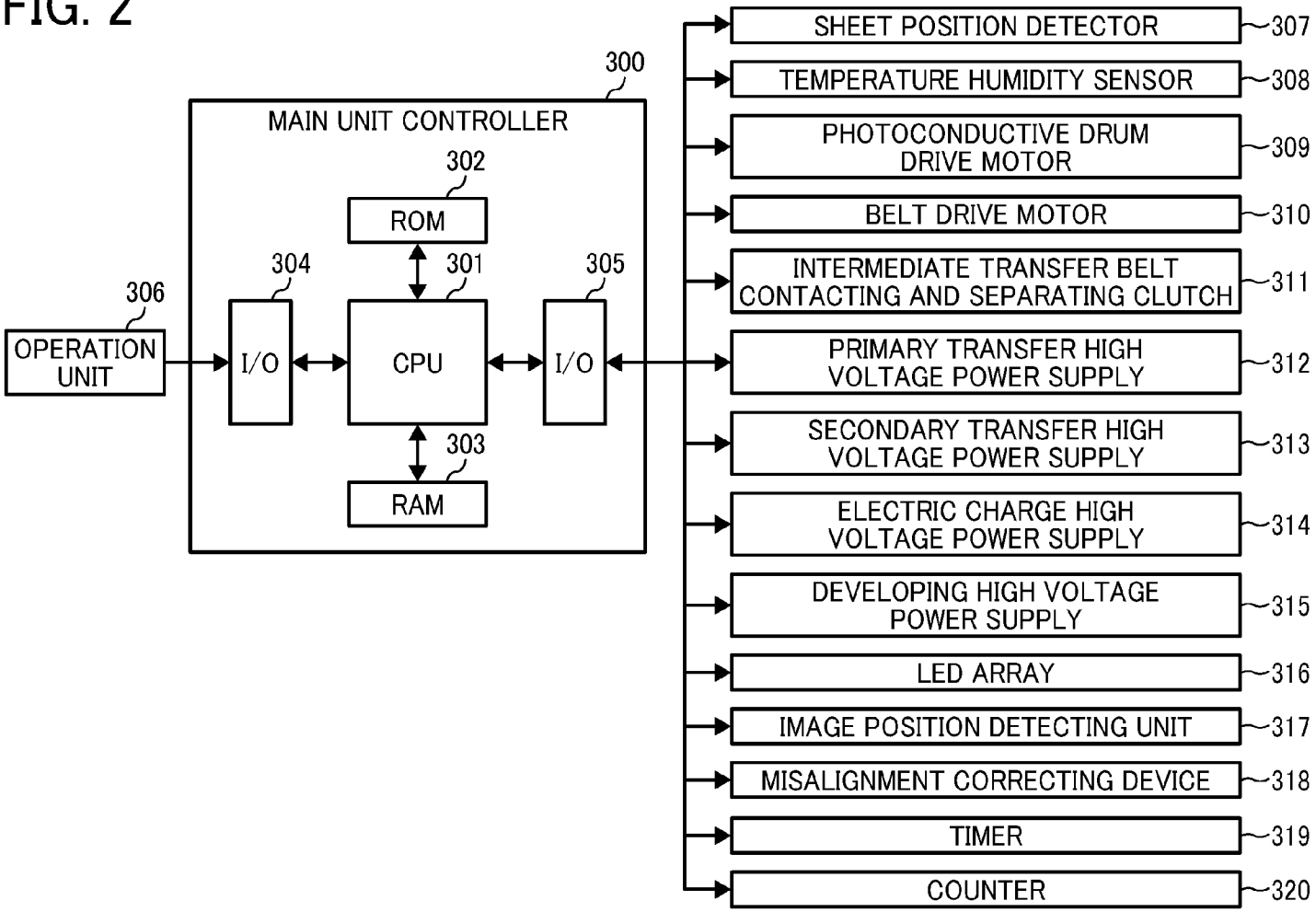
FIG. 2 is a block diagram illustrating an exemplary control system employed in the printer of FIG. 1 according to one embodiment of the present invention.

FIG. 2 is a diagram illustrating a control system included in the printer 1. As there shown, the main unit controller 300 includes a CPU (Central Processing Unit) 301, a memory including a ROM (Read Only Memory) 302 and a RAM (Random Access Memory) 303, and multiple I/O (Input and Output) ports 304 and 305 to receive data input thereto and to output data therefrom, respectively. The I/O port 304 is connected to an operation unit 306. By contrast, the I/O port 305 is connected to a recording sheet position detector 307, a temperature humidity sensor 308, and a photoconductive drum drive motor 309 as well. The I/O port 305 is also connected to a belt drive motor 310, an intermediate transfer belt contacting and separating clutch 311, and a primary transfer high voltage power supply 312 as well. The I/O port 305 is further connected to a secondary transfer high voltage power supply 313, an electric charge high voltage power supply 314, and a developing high voltage power supply 315 as well. The I/O port 305 is yet further connected to an LED (Laser Emitting Diode) array 316, an image position detecting unit 317, and a misalignment correcting device 318 as well. The I/O port 305 is yet further connected to a timer 319 and a counter 320 or the like.

The recording sheet position detector 307 calculates (i.e., detects) a position of the recording sheet 105 based on a time when a pair of registration rollers starts rotating thereof. The temperature humidity sensor 308 acquires information of environment of an interior of the main unit of the printer 1. The intermediate transfer belt contacting and separating clutch 311 changes a track of the intermediate transfer belt 101 by separating the intermediate transfer belt 101 from the photoconductive drums 200 included in the image forming unit 100 accommodating multiple component colors other than black when a monochrome image is formed and primarily transferred.

The misalignment correcting device 318 is constituted by a process controller that controls an image forming engine (e.g., hardware and a process) including each of the image forming units 100, the optical scanning unit 202, and the intermediate transfer belt 101. The misalignment correcting device 318 is also constituted by an interface controller that receives various inputs of detection signals and outputs various control signals from and to the hardware, respectively. Each of the process controller and the interface controller is mainly composed of an information processing device mainly including either a MPU (Micro Processing Unit) or a CPU (Central Processing Unit).

Now, an exemplary system of forming the multiple patch images is herein below described in detail with reference to an applicable drawing. Specifically, the multiple patch images are formed on the intermediate transfer belt 101 prior to formation and transfer of a full-color toner image onto a recording sheet 105. For example, the multiple patch images are formed at both times when an image forming apparatus (i.e., the printer 1) starts and when the image forming apparatus returns from a halt. Here, the time to start the image forming apparatus represents a time shortly after a main power supply provides power thereto when a main power switch is turned on, for example. Whereas, the time when the image forming apparatus returns from the halt represents a time immediately after the image forming apparatus rejoins a standby mode enabling it to execute printing therein from an energy saving mode, in which power is saved. In both situations, image formation of the multiple patch images and calculation of a correction amount of misalignment of the multiple patch images are serially executed as a series of operations.

This series of operations is also desirably executed when the temperature humidity sensor 308 of FIG. 2 detects a prescribed level of a change in temperature, when the timer 319 detects elapsing of a given time period, and the counter 320 detects a given number of recording sheets printed or the like as well. Here, the multiple patch images are formed on a surface of the photo-conductive drum within an interval between successively fed recording sheets thereto without stopping printing operation when one of the above-described temperature, the given time period, and the given number of recording sheets detected by the temperature humidity sensor 308, the timer 319, and the counter 320, respectively, reaches the prescribed level.

Figure 3:
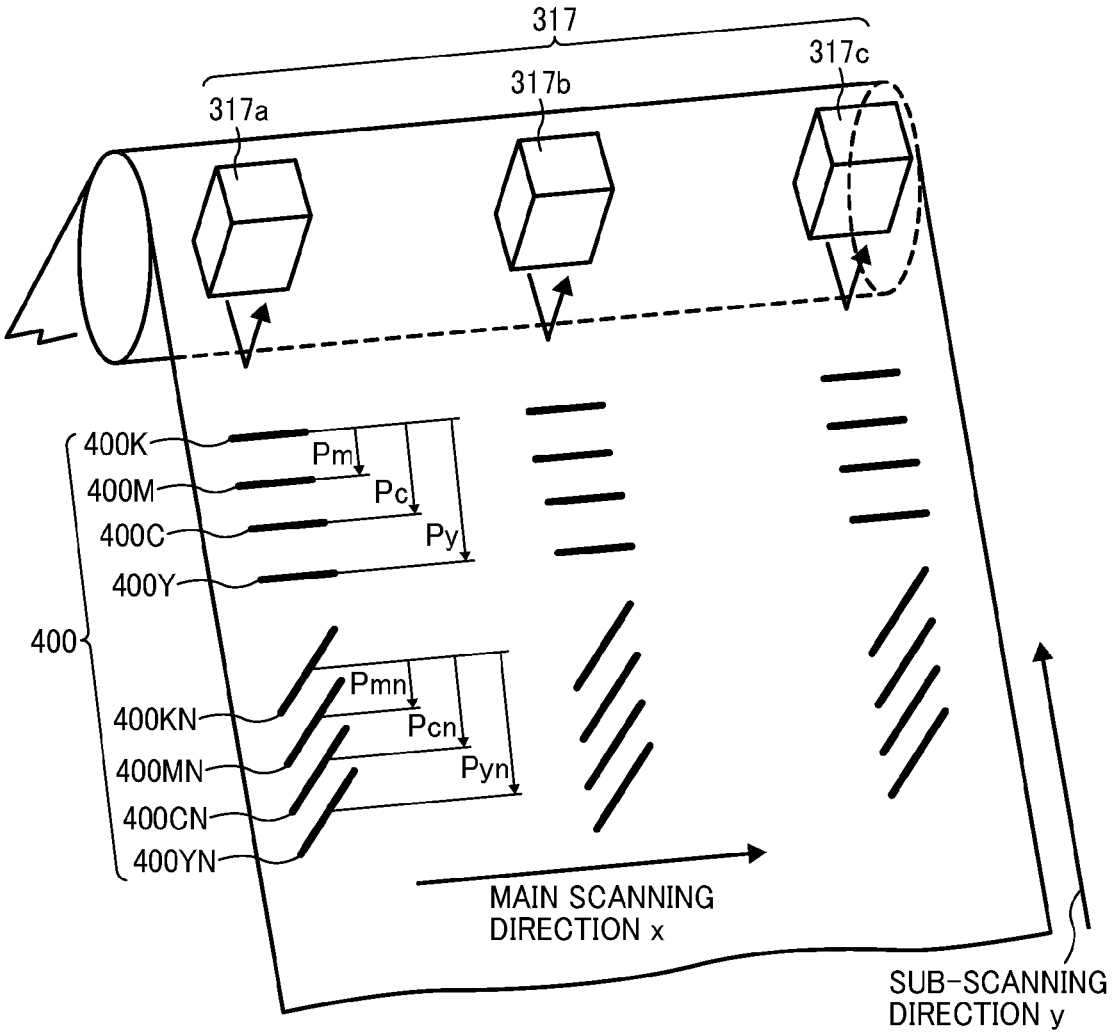
FIG. 3 is an enlarged perspective view illustrating exemplary multiple patch images of respective component colors formed on a secondary transfer belt according to one embodiment of the present invention.
Figure 4:
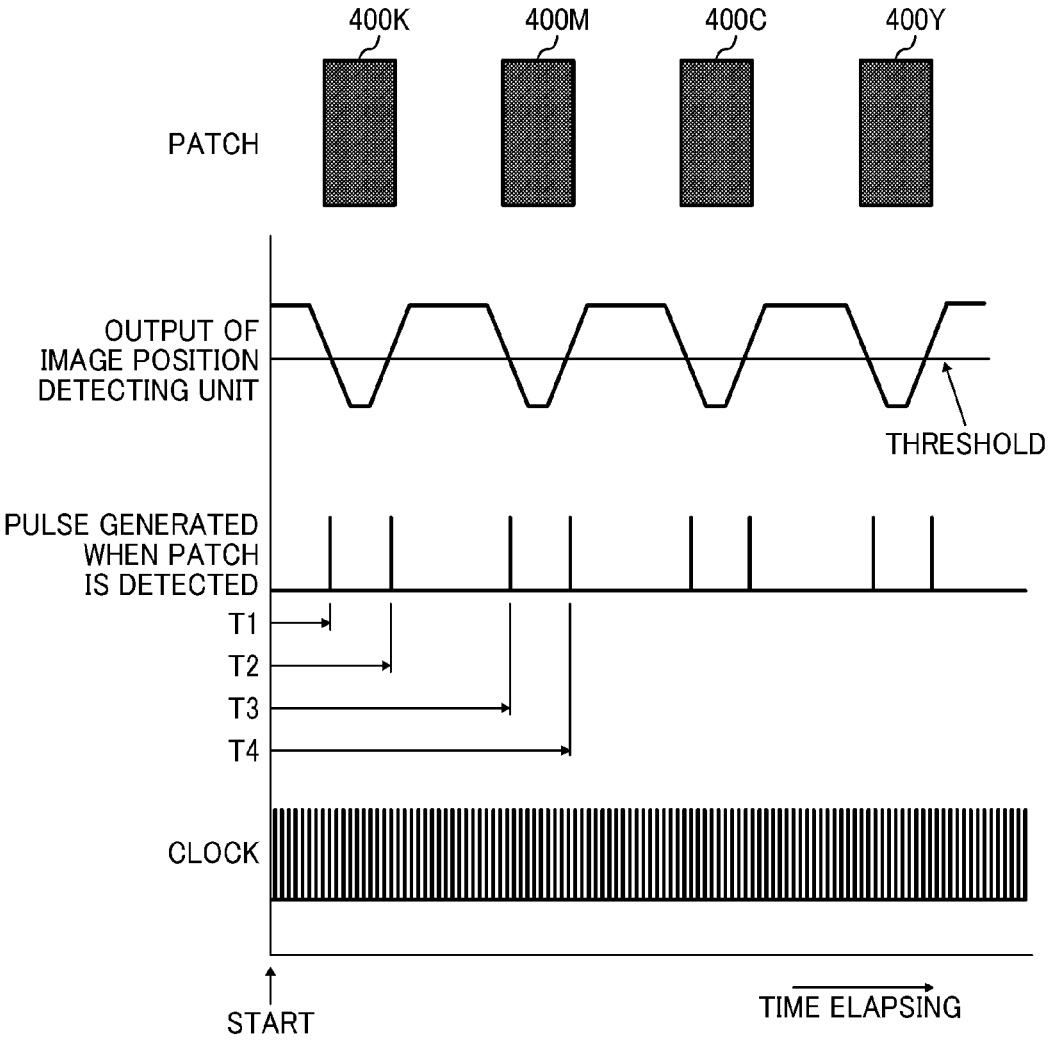
FIG. 4 is a time chart illustrating exemplary signals and pulses generated when the multiple patch images of respective component colors are detected to subsequently calculate intervals between the multiple patch images according to one embodiment of the present invention.

Now, a system of calculating an amount of misalignment of each of patch images of respective component colors by using regular reflection light is herein below described in greater detail with reference to FIGS. 3 and 4. FIG. 3 is an enlarged perspective view illustrating exemplary patch images of respective component colors secondarily transferred and formed on the secondary transfer belt 110. FIG. 4 is a time chart illustrating an exemplary sequence of detecting the patch images 400K, 400M, 400C, and 400Y and 400KN, 400MN, 400CN, and 400YN of respective component colors and calculating various intervals between applicable patch images of respective component colors. As shown in FIG. 3, a set of patch images 400 (400K, 400M, 400C, and 400Y and 400KN, 400MN, 400CN, and 400YN) of respective component colors is formed by the respective image forming units 100K, 100M, 100C, and 100Y as shown in FIG. 1 and is transferred onto different positions on the intermediate transfer belt 101 in the sub-scanning direction thereof to detect misalignment per component color. Then, the set of patch images 400 (400K, 400M, 400C, and 400Y and 400KN, 400MN, 400CN, and 400YN) transferred onto the intermediate transfer belt 101 are secondarily transferred onto the secondary transfer belt 110. An image position detecting unit 317 acting as a sensor composed of a set of image position detectors 317*a*, 317*b*, and 317*c* then detects the set of these patch images 400 (400K, 400M, 400C, and 400Y and 400KN, 400MN, 400CN, and 400YN) of corresponding component colors, respectively. The misalignment correcting device 318 of FIG. 1 calculates various time intervals (i.e., relative time differences) between a time when a detection signal of one specific patch image of a component color (here, a black patch image 400K) and times of detection signals of the respective patch images 400Y, 400M, and 400C of remaining Y, M, and C colors. In accordance with the relative time differences calculated in this way, sub-scanning positions (i.e., positions in a circumferential direction) on the respective photoconductive drums 200 exposed to laser light beams emitted from a semiconductor laser of the optical scanning unit 202 of FIG. 1 are adjusted to render the relative time differences prescribed targeted levels, respectively. That is, respective images of the other colors M, C, and Y (superimposed later) are formed (i.e., secondarily transferred thereon) at prescribed positions on the secondary transfer belt 110 to match with targeted pitch intervals of the other respective component colors M, C, and Y from a position at which the black patch image is formed thereon. Hence, based on the horizontal linear patch images 400K, 400M, 400C, and 400Y as shown in FIG. 3, respective registration positions for images of all component colors K, M, C, and Y are aligned in the sub-scanning direction. Whereas respective registration positions for the images of all component colors K, M, C, and Y in the main scanning direction are aligned based on differences in time interval between the horizontal linear patch images 400K, 400M, 400C, and 400Y and oblique line patch images 400KN, 400MN, 400CN, and 400YN, respectively.

The above-described example is based only on one set of color patch images (i.e., 400K, 400M, 400C, and 400Y and 400KN, 400MN, 400CN, and 400YN). However, since an error actually occurs during the above-described calculation due to a mechanical change in speed, multiple sets of the similar color patch images are also formed in the sub-scanning direction. That is, registration correction values are similarly calculated multiple times in a similar manner as described above, and are subsequently averaged. Based on the averaged registration correction values, the periodic mechanical error can be minimized.

As shown in FIG. 3, three sets of the patch images 400 are formed separately side by side at three locations on the secondary transfer belt 110 in the main scanning direction x. That is, two sets of patch images located at left and right ends are formed at both ends of an image writing region. The remaining set of patch images is formed in the middle of the image writing region. Here, the image writing region represents a range, in which a toner image is formed and is transferred onto a recording sheet therefrom. In determining and setting the above-described adjustment values (i.e., registration correction values in both main and sub-scanning directions x and y for all component colors), adjustment values of skew of scanning lines and those of scanning widths can be also determined at the same time for images of all component colors K, M, C, and Y by using the respective color patch images formed within the image writing region at the three locations as well.

Since it includes a light emitting element and a light receiving element, a light beam emitted from the light emitting element is regularly reflected by the secondary transfer belt 110 and arrives at the light receiving element in each of the image position detectors 317*a*, 317*b*, and 317*c*. Hence, when the secondary transfer belt 110 bears the set of patch images 400K, 400M, 400C, and 400Y and 400KN, 400MN, 400CN, and 400YN thereon, an amount of light received by corresponding one of the light receiving elements changes, and accordingly a detection signal corresponding to the set of patch images 400K, 400M, 400C, and 400Y and 400KN, 400MN, 400CN, and 400YN is outputted from the image position detecting unit 317 (i.e., the image position detectors 317*a*, 317*b*, and 317*c*) as shown in FIG. 4. The detection signal is then compared with a prescribed threshold, and a pulse outputting waveform having pulses generated when respective edges of the patch images are detected (i.e., at both edges of each of the patch images) is obtained as shown in FIG. 4. Subsequently, a number of clocks is counted from a start (START in FIG. 4) until each of the pulses generated when the edges of the patches of respective component colors K, M, C, and Y are detected. The numbers of clocks of respective component colors are converted into time periods T1, T2, T3, and T4 and so on as time periods starting from the start (START in FIG. 4), respectively. Based on this result, a value TK representing black patch central information of the patch image 400*k* is calculated by using the below described equation; TK=(T1+T2)/2. At the same time, a value TM representing magenta patch central information of the patch image 400M is calculated by using the below described equation; TM=(T3+T4)/2. Also, values representing central information of the patch images 400C and 400Y are similarly calculated by using the similar equations, respectively, as well. Subsequently, a patch interval Pm between 400K and 400M as shown in FIG. 3 is calculated by using the below described equation; Pm=(TM−TK). At the same time, respective patch image intervals Pc, Py, Pmn, Pcn, and Pyn are also calculated by using the similar calculation formulas as well.

In the image forming apparatus, since either different color toner images or different color inks are sequentially stacked and superimposed on the same recording sheet one after another, color shift highly likely occurs. For example, in a laser printer as one of the image forming apparatus that employs a Carlson process, as a photoconductive drum rotates, a latent image is formed and developed sequentially thereby obtaining a toner image. The toner image is then transferred from an image bearer onto a recording medium. However, since either a shaft of the photoconductor drum is sometimes eccentric or rotational speed of a drive motor that drives the photoconductive drum generally varies, a time period from when the latent image is formed until when the toner image is transferred onto the recording medium accordingly varies. As a result, since intervals between images written by respective optical scanning operations (i.e., scanning line pitches) become uneven, density of an image obtained after a transfer process becomes uneven in the sub-scanning direction.

Accordingly, to solve the above-described problems of uneven density, color shift, and discoloration, eccentricity of the shaft of the photoconductive drum, and the change in rotational speed of the drive motor need to be eliminated. However, due to a limit to processing, variation of load in a power transmission system, and thermal expansion or the like, it is generally impossible to completely eliminate distortion of the shaft of the photoconductive drum. Accordingly, neither the above-described eccentricity nor the change in rotational speed is completely eliminated. Because of this, to avoid generation of the change in speed of the photoconductive drum as much as possible, a change in rotational speed thereof is detected and corrected.

Further, in a tandem type color image forming apparatus, in which multiple toner images of respective component colors are superimposed one by one to generate a full-color toner image, due to relative displacement of the toner images of the multiple component colors, color shift and/or discoloration occur, thereby degrading quality of an image. Toner transferred from the photoconductive drum onto the transfer belt in a primary transfer process is conveyed while overlying the transfer belt. However, since a velocity of the transfer belt, and accordingly a time period needed for the transfer belt to move from a present photoconductive drum to the next photoconductive drum fluctuates due to eccentricity of a rotary shaft thereof or a fluctuation of rotational speed of a drive motor that drives the transfer belt, toner borne on the present photoconductive drum hardly aligns with another toner transferred from the next photoconductive drum, thereby causing the color shift again on the transfer belt. In addition, in the above-described tandem type color image forming apparatus, an optical scanning device provided therein to form latent images on the respective photoconductive drums possibly causes color shift and discoloration again unless registration of multiple latent images of respective component colors formed by the optical scanning device are precisely adjusted. When inclinations of the scanning lines written by the optical scanning device is different from each other or degrees of bending of scanning lines written by the optical scanning device are different from each other, color shift and discoloration similarly occur again.

Unevenness of a pitch is generally created in an image due to synthesis of a low frequency component, such as rotation unevenness of a photoconductive drum, that of driving rollers for driving the intermediate transfer belt and a conveyor belt, etc., and a high frequency component, such as gear engagement in a drive transmission system, etc. Due to a growing demand for the image quality, since a high precision gear is increasingly spreading recently, the photoconductor drum and the intermediate transfer belt that directly affect degradation of the image quality increasingly employ a direct driving system to avoid an impact of backlash caused in the transmission system. That is, since the backlash directly affects image quality (i.e., the image quality is degraded), the photoconductive drums and the intermediate transfer belt are increasingly directly driven to avoid the backlash in the transmission system. Hence, the high frequency component is decreased recently by using a flywheel that increases inertia of a driving system. However, the high frequency component is yet incompletely removed.

In addition, the impact of the low frequency component created by the eccentricity of parts due to limit to machining precision and the change in load cause by variation in assembly or the like cannot be avoided. Accordingly, a method of suppressing such a problem becomes important recently. In particular, in the tandem type color image forming apparatus, a phase and an amplitude in a cycle of a waveform of pitch unevenness caused by variation in toner image transfer times in the sub-scanning direction are different between multiple component color images. In view of this, multiple dot positions of the respective component color images cannot precisely coincide with each other in the above-described system.

Further, to equalize registrations of the latent images of respective component colors with each other, shifts of the registration are detected based on component color images transferred onto the transfer belt, and positions of the latent images in the main and sub-scanning directions are adjusted by varying writing start times in both directions, respectively. As already described earlier, in the registration correction process, the multiple patch images of respective component colors of patch pattern toner images having both diagonal and horizontal lines are formed on the multiple photoconductive drums, respectively, to detect displacements in the main and sub-scanning directions at the transfer positions, respectively. The patch images of the respective component colors are then transferred side by side onto the transfer belt driven at the same time. Subsequently, multiple times when the patch images of the respective component colors transferred and borne on the intermediate transfer belt side by side pass through a prescribed position are respectively detected. Based on the result of the above-described detection, multiple intervals between the patch images of the respective component colors are detected. After that, based on the interval detected in this way, displacement amounts of respective patch images of the component colors generated at the transfer positions, at which the component color toner images are transferred from the respective photoconductive drums onto the intermediate transfer belt, are detected (i.e., calculated). Based on the amounts of displacement, the displacements of multiple patch images of the respective component colors at the transfer positions are corrected by adjusting either times of exposing the respective photoconductive drums or rotation speeds of the respective photoconductive drums.

Hence, in the above-described color shift correcting system, the multiple patch images are formed, the intervals between the patch images are then read and detected, and the correcting amounts of the color shifts are calculated, respectively, thereby ultimately correcting the color shifts in the main and sub-scanning directions, respectively. Since such color shift correction may be performed before a start of printing, a color image having a less amount of component color shift can be obtained in such a situation. The above-described three sensors 317 to 317*c*, located at the three locations of the both ends and the center in the main scanning direction as shown in FIG. 3, each detects the intervals of patch images 400 of the respective component colors, and calculates registration shift amounts in each of the main and sub-scanning directions based on registration positions of the patch images (400K and 400KN) of black, respectively. As a result of the above-described calculation, registration times for images in the main scanning direction, magnification levels therefor, the registration times therefor in the sub-scanning direction, correction amounts of skew therefor, and correction amounts of secondary scanning line curvatures are calculated based thereon.

Further, to upgrade accuracy of correction of the color shift, one conventional system changes a detection condition of a sensor included therein to detect multiple component color patch images by changing an amount of light beam emitted from the LED array in accordance with situations whether it detects density or component color shift. That is, the above-described sensor similarly detects multiple patch images of the respective component colors borne on an intermediate transfer belt. However, in recent years, to accommodate various recording sheets including an embossed paper sheet or the like, an intermediate transfer belt is increasingly constituted by an elastic member. With this intermediate transfer belt, however, since a surface thereof includes a rubber layer, only a small amount of light beam can be reflected. Consequently, a positive reflection type sensor hardly detects a black toner image borne thereon. Because of this, multiple patch images of respective component colors are transferred from the intermediate transfer belt 101 onto a secondary transfer belt, and these multiple patch images of the respective component colors are then detected by a sensor on the secondary transfer belt for the first time. In view of this, the secondary transfer belt is made of material capable of providing positive reflective light.

Figure 5:
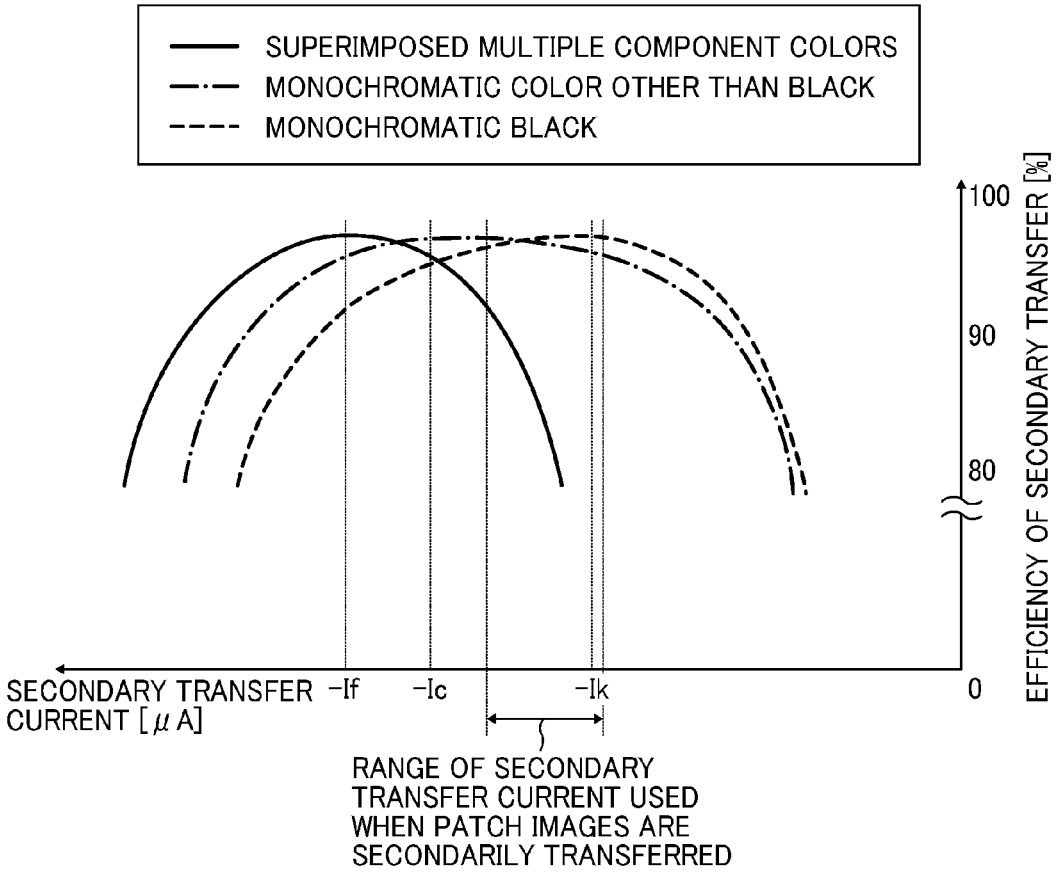
FIG. 5 is a graph illustrating an exemplary relation between a secondary transfer current value and secondary transfer efficiency obtained under an optional environmental condition according to one embodiment of the present invention.
Figure 6:
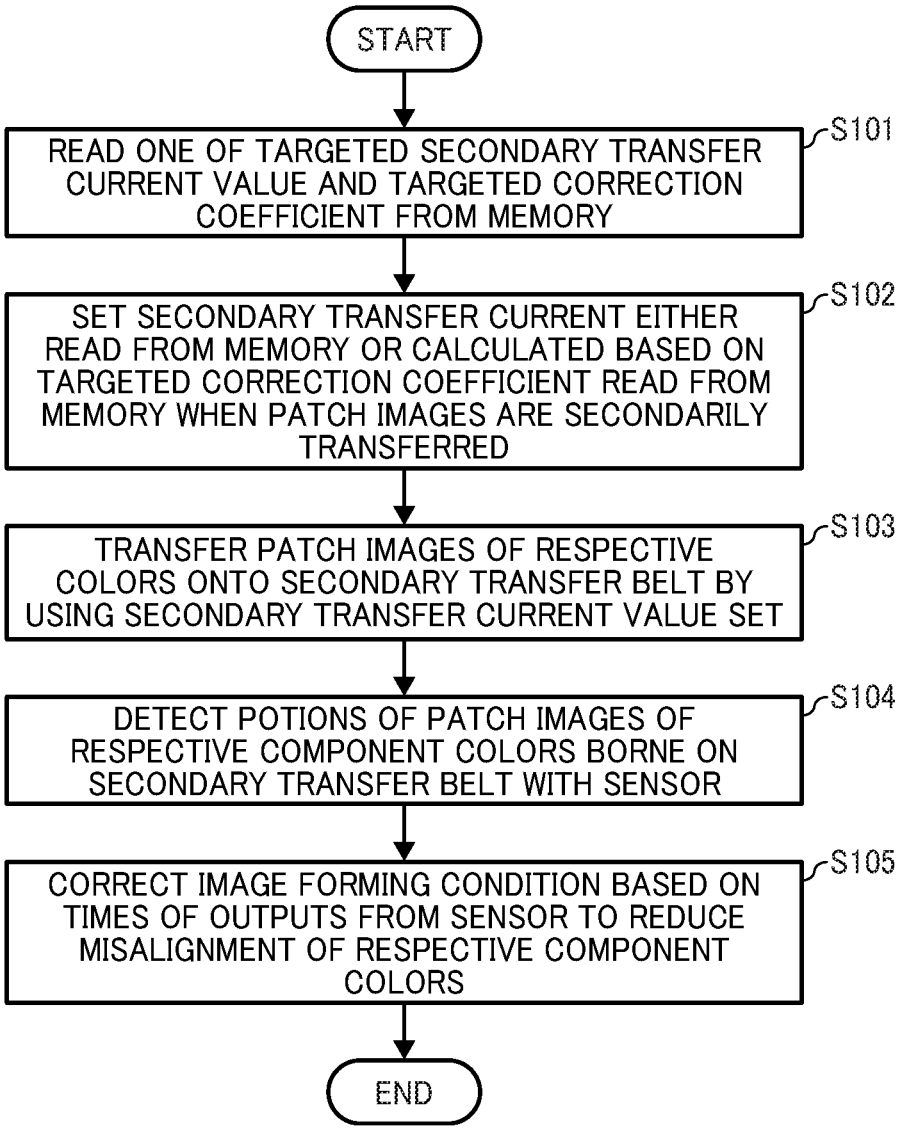
FIG. 6 is a flowchart illustrating an exemplary sequence of setting a secondary transfer condition for the multiple patch images and correcting an image forming condition according to one embodiment of the present invention.

Now, one of features of the image forming apparatus according to one embodiment of the present invention is described with reference to FIGS. 5 and 6, in which an exemplary system of setting a secondary transfer condition under which multiple patch images of respective component colors are secondarily transferred onto the secondary transfer belt, is described. FIG. 5 is a diagram illustrating an exemplary relation between a value of a secondary transfer current and secondary transfer efficiency, obtained under an optional environmental condition. FIG. 6 is a flowchart illustrating an exemplary sequence of setting a secondary transfer condition for multiple patch images of respective component colors and correcting an image forming condition. As shown there, a horizontal axis of FIG. 5 represents a value of secondary transfer current [μA]. A vertical axis of FIG. 5 represents a degree [%] of secondary transfer efficiency as well. Characteristics shown in FIG. 5 are sought when temperature is about 20° C. while humidity is about 50 [%]. Also as shown there, since changes in characteristics of colors other than black, i.e., magenta, cyan, and yellow, are substantially the same with each other, only one characteristic change is typically indicated in FIG. 5.

As shown there, a secondary transfer current value providing the best secondary transfer efficiency to toner of black component color is −Ik. A secondary transfer current value providing the best secondary transfer efficiency to toner of component colors other than black is −Ic. A secondary transfer current value providing the best secondary transfer efficiency to toner of superimposed multiple component colors is −If. As also shown there, the secondary transfer current values respectively providing the best secondary transfer efficiencies to toner of each of single component colors and that to superimposed multiple component colors are about 90% or more. As described earlier with reference to FIG. 1, the multiple patch images of respective component colors formed on the intermediate transfer belt 101 are secondarily transferred by the secondary transfer rollers 104 onto the secondary transfer belt 110. Here, as shown in FIG. 3, the multiple patch images 400 of respective component colors detected by using the regular reflected light are composed of linear patterns, respectively. As also described earlier, the image position detecting unit 317 detects edges of the patch images 400 of the respective component colors. Accordingly, the linear patch images 400 of the respective component colors need to be transferred while avoiding misalignments of the linear patch images of the respective component colors. Further, when a full component color superimposed toner image is secondarily transferred, in view of superposition of multiple component colors (i.e., color toner particles) or the like, either a secondary transfer voltage or a secondary transfer current each serving as a secondary transfer condition is relatively decreased to decrease an amount of each of toner particles of respective components colors adhering to a recording medium below either a secondary transfer voltage or a secondary transfer current under which a single component color image is formed on (i.e., a monochrome toner image is secondarily transferred onto) the recording medium. Specifically, as shown in FIG. 5, a current value −If meeting the below described inequality is set as a transfer current to be used when a toner image composed of the superimposed multiple component colors is secondarily transferred: −Ik>−Ic>−If.

Specifically, as shown there, a secondary transfer current providing the best secondary transfer efficiency to toner of a toner image is different in accordance with a type thereof, such as a monochrome toner, single color toner (i.e., magenta, cyan, and yellow toner) other than the monochrome toner, the multiple component color superimposed toner, etc. That is, such a difference comes from a difference in material between component color toner or the like. Accordingly, when the secondary transfer current value −If lower than those of −Ik and −Ic, which is used when the toner image composed of the superimposed multiple component colors is secondarily transferred, is set to be commonly used as secondarily transfer current values for the toner images of the single component colors (e.g., a monochrome), secondary transfer efficiency relatively deteriorates depending on the component color. As a result, an amount of toner adhering to each of the patch images of the respective black component color and given component colors other than black relatively decreases on the secondary transfer belt 110, accordingly. In particular, the secondary transfer efficiency of the black component color is apparently degraded. Further, with the secondary transfer current set and used when the toner image of superimposed multiple component colors is secondarily transferred, secondary transfer efficiency of one of the multiple component colors can relatively increase. By contrast, the secondary transfer efficiency of each of the other component colors can relatively decrease. In any one of the above-described situations, even though secondary transfer efficiency varies depending on component color, no substantive issue of image quality or the like occurs as long as the toner image is formed (i.e., secondarily transferred) while superimposing the multiple component colors.

As shown in FIG. 5, the component color images other than the black image have stable secondary transfer efficiency while having wide ranges of a secondary transfer current capable of providing better secondary transfer current. By contrast, when the toner image of the single component color of black is formed (i.e., secondarily transferred), a range of a secondary transfer current providing better secondary transfer efficiency is narrow. Accordingly, when the secondary transfer current value −Ic used when a monochromatic component color toner image other than the black toner image is secondarily transferred is set as the secondary transfer current value for all of component colors, transfer efficiency of the black color patch image deteriorates. Hence, according to one embodiment of the present invention, as shown in FIG. 5, a transfer condition setting device sets a prescribed secondary transfer current value, which is capable of decreasing a difference in transfer efficiency of toner between component colors when patch images of the respective component colors are secondarily transferred onto the secondary transfer belt below a difference in transfer efficiency of toner between the component colors caused when the patch images of the respective component colors are secondarily transferred onto the secondary transfer belt under the same transfer condition as a toner image of the multiple component color superimposed multiple component colors is secondarily transferred onto the recording sheet. For example, a transfer condition setting device sets a secondary transfer current value that falls within the range as shown by the arrow in FIG. 5 as the secondary transfer current value, with which each of the patch images of the respective component colors is secondarily transferred as is. With this, a difference in toner adhering amount between patch images of the respective component colors is decreased below a difference caused when each of the patch images of the respective component colors is secondarily transferred onto the secondary transfer belt under the same condition as a toner image composed of the multiple component color superimposed multiple component colors is secondarily transferred onto the recording sheet in a conventional configuration.

When edges of the patch images of the respective component colors are detected by the image position detecting unit 317, inclinations of falling or rising portions of sensor outputs fluctuate in accordance with a toner adhering amount of the patch images of the respective component colors. That is, when the difference in toner adhering amount between the patch images of the respective component colors is decreased, a difference in angle of rising or falling inclination between sensor outputs of respective component colors is also decreased at the same time as well. Accordingly, a fluctuation of the time of an output from each of the sensors for respective component colors is suppressed. Since a position of the patch image is detected based on a time of an output from the sensor, the location of the component color patch image can be accurately detected at the same time accordingly. As a result, relative misalignment caused between component colors in the toner image of superimposed multiple component colors is also sufficiently reduced at the same time as well.

Now, an exemplary secondary transfer condition setting process for setting a secondary transfer condition for patch images of the respective component colors and an exemplary correcting process of correcting an image forming condition are specifically described herein below with reference to FIG. 6. Specifically, since it is previously stored in a memory (a RAM 303 in FIG. 2), a prescribed secondary transfer current value falling within the prescribed range is read from the memory (in step S101) as shown in FIG. 6. Here, the prescribed secondary transfer current value is capable of decreasing a difference in transfer efficiency of toner between component colors caused when multiple patch images of respective component colors are secondarily transferred onto the secondary transfer belt below a difference in transfer efficiency of toner between component colors caused when multiple patch images of respective component colors are secondarily transferred onto the secondary transfer belt under the same secondary transfer condition as a toner image of superimposed multiple component colors is transferred onto a recording sheet. Otherwise, since it is also stored in a memory (a RAM 303 in FIG. 2), a correction coefficient used to calculate a targeted secondary transfer current value by multiplying an initially set secondary transfer current value for a full-color toner image is read from the memory (in step S101). Subsequently, the prescribed secondary transfer current value read from the memory is set as a secondary transfer current value to be used when multiple patch images of respective component colors are secondarily transferred (in step S102). Otherwise, the targeted secondary transfer current value obtained by multiplying the initially set secondary transfer current value with the correction coefficient read from the memory is set as the secondary transfer current value to be used when multiple patch images of respective component colors are secondarily transferred (in step S102). Then, with the prescribed secondary transfer current value, the multiple patch images of respective component colors are secondarily transferred onto the secondary transfer belt (in step S103). A sensor subsequently detects positions of multiple patch images of respective component colors borne on the secondary transfer belt (in step S104). Based on respective times of outputs from the sensor, an image forming condition (e.g., an exposing time and/or a driving speed profile or the like) is corrected to minimize relative misalignment generated between the multiple patch images of respective component colors (in S105).

Here, when the secondary transfer current value −Ik that falls within the prescribed range as shown in FIG. 5 is set as the secondary transfer current value to be used when multiple patch images of respective component colors borne on the intermediate transfer belt are secondarily transferred onto the secondary transfer belt, secondary transfer efficiencies of monochromatic colors other than the black component color do not greatly deteriorate. As a result, a difference in toner adhering amount between patch images of the respective component colors transferred and borne on the secondary transfer belt becomes smaller than a difference in toner adhering amount between each of superimposed multiple component colors of a toner image when the toner image having superimposed multiple component colors is secondarily transferred onto the recording sheet as in the conventional system. Hence, the secondary transfer current value for the black component color may be set and utilized as a secondary transfer electric current as a secondary transfer condition under which multiple patch images of respective component colors are secondarily transferred. Hence, when multiple patch images of respective component colors are formed (i.e., secondarily transferred) under a secondary transfer condition used when a black toner image, which is usually formed frequently as a monochromatic toner image, is secondarily transferred, multiple linear patch images are thickened, thereby making amounts of toner adhering to the linear patch images in a widthwise direction thereof in the main scanning direction uniform. Heretofore, the various embodiments are described based on usage of the secondary transfer current controlled by constant current drive. However, the above-described various embodiments can be based on usage of a secondary transfer voltage controlled by constant voltage drive as well.

Hence, in the secondary transfer process of secondarily transferring the multiple patch images of respective component colors, since the secondary transfer condition is set as described above, a difference in transfer efficiency of toner between component colors caused when the multiple patch images of respective component colors are secondarily transferred onto the secondary transfer belt becomes smaller than a difference in transfer efficiency of toner between component colors caused when the multiple patch images of respective component colors are secondarily transferred onto the secondary transfer belt under the same transfer condition as the toner image of superimposed multiple component colors is transferred onto the recording sheet. Accordingly, a difference in toner adhering amount between multiple patch images of respective component colors caused when the multiple patch images of respective component colors are secondarily transferred onto the secondary transfer belt becomes smaller than a difference in toner adhering amount between multiple patch images of respective component colors caused when multiple patch images of respective component colors are secondarily transferred onto the secondary transfer belt under the same transfer condition as the toner image of superimposed multiple component colors is transferred onto the recording sheet in the conventional system. When a difference in toner adhering amount between multiple patch images of respective component colors becomes smaller, since a difference in rising or falling inclination between outputs from the sensors for respective component colors also becomes smaller, a fluctuation of an output time of the sensor is accordingly suppressed. Since locations of the patch images of the respective component colors are detected based on times of outputs from the sensor, positions of the patch images of the respective component colors can be accurately detected, respectively. As a result, misalignment of the patch images of the respective component colors can be preferably (i.e., precisely) calculated, and accordingly relative misalignment of the superimposed multiple component colors in the full-color toner image can be sufficiently reduced at the same time.

Figure 7:
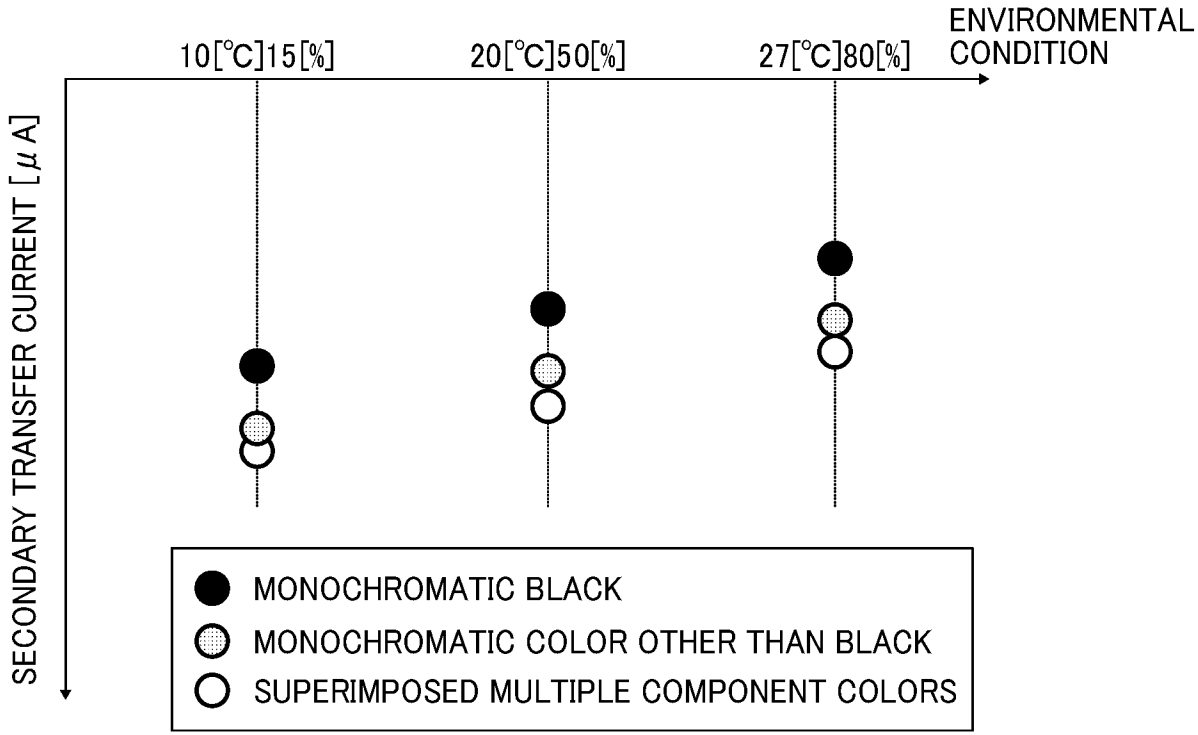
FIG. 7 is a graph illustrating exemplary secondary transfer current values that maximize the secondary transfer efficiency in accordance with the environmental condition according to one embodiment of the present invention.
Figure 8:
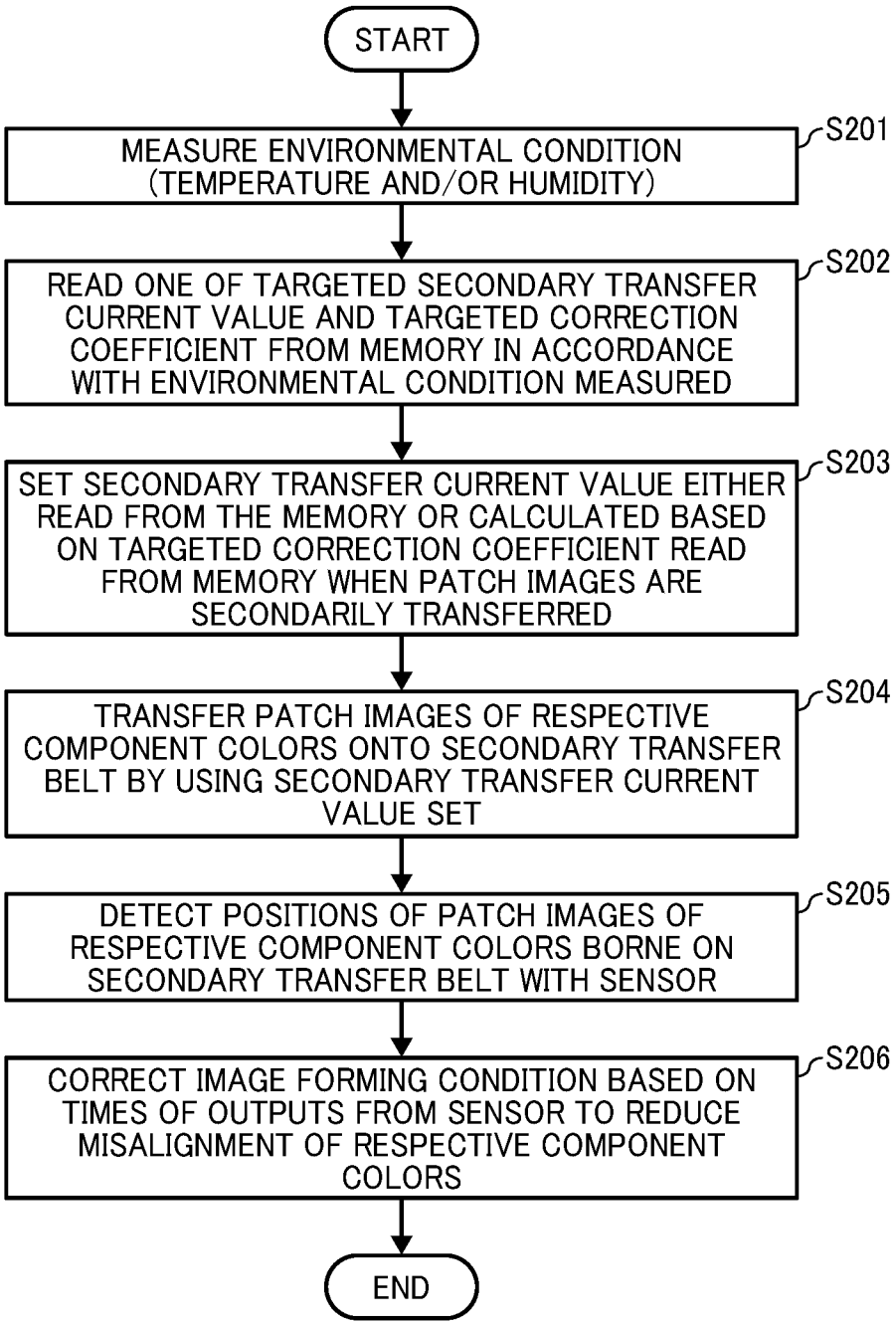
FIG. 8 is a flowchart illustrating an exemplary modification of the sequence of setting the secondary transfer condition for the multiple patch images and correcting the image forming condition according to another embodiment of the present invention.

Now, an exemplary modification of the secondary transfer condition setting device that sets a secondary transfer condition for patch images of the respective component colors and an exemplary correcting process of correcting an image forming condition are specifically described with reference to FIGS. 7 and 8. That is, FIG. 7 is a diagram illustrating an exemplary relation between various environmental conditions and optimum secondary transfer current that maximizes secondary transfer efficiency determined in accordance with the various environmental conditions. FIG. 8 is a flowchart illustrating an exemplary modification of the sequence of setting the secondary transfer condition for the multiple patch images of respective component colors and correcting the image forming condition. As shown in FIG. 7, a horizontal axis indicates an environmental condition and a vertical axis indicates a secondary transfer current value [μA].

Since a resistance value of the secondary transfer belt and the recording sheet changes in accordance with an environmental condition (e.g., temperature and humidity or the like), a secondary transfer condition under which multiple patch images of the respective component colors are formed (i.e., secondarily transferred), also needs to change in accordance with the environmental condition as well. For example, under a high temperature and humidity condition, the secondary transfer belt tends to absorb moisture thereby decreasing a resistance value of the secondary transfer belt. As a result, as electrostatic force acting on toner particles positively grows, power to bring the toner particles back from the secondary transfer belt to the intermediate transfer belt (i.e., an image bearer) is proportionally weakened, for example. When the secondary transfer belt absorbing the moisture enters the secondary transfer nip, a prescribed amount of electrostatic force is applied to the toner borne on the secondary transfer belt. The electrostatic force applied to the toner gradually grows therein positively as time elapses. That is, the secondary transfer belt having the decreased resistance value due to absorption of the moisture rapidly and increasingly stores electric charge therein after entering the secondary transfer nip, and the toner particles borne on the secondary transfer belt become hardly brought back to the intermediate transfer belt therefrom.

By contrast, when the secondary transfer belt not absorbing the moisture therein, since the electrical resistance value of the secondary transfer belt is relatively high, electric charge is significantly slowly stored in the transfer nip. Hence, since the toner particles can actively reciprocate between a surface of the secondary transfer belt and the intermediate transfer belt, a sufficient amount of toner particles can be transferred onto the surface of the secondary transfer belt accordingly. By contrast, however, since the secondary transfer belt absorbing the moisture therein quickly stores the electric charge shortly after entering the secondary transfer nip, the secondary transfer belt does not allow the toner particles to reciprocate between the surface of the secondary transfer belt and the intermediate transfer belt, and accordingly an amount of toner particles transferred onto the surface of the secondary transfer belt becomes insufficient. In view of this, when environment of the image forming apparatus is the high temperature and humidity condition, a value of secondary transfer current is decreased to reduce an amount of electric charge generated in the secondary transfer nip thereby rendering the toner particles sufficiently reciprocating between the surface of the secondary transfer belt and the intermediate transfer belt. As a result, a sufficient amount of toner particles can be transferred onto the surface of the secondary transfer belt.

Further, as shown in FIG. 7, a secondary transfer current value for black, that for each of monochromatic component colors other than black, and a secondary transfer current value for the superimposed multiple component colors vary in accordance with a combined environmental condition (e.g., 10[° C.] and 15[%], 20[° C.] and 50[%], and 27[° C.] and 80[%]). In view of this, according to another modification, a prescribed secondary transfer current value capable of maximizing secondary transfer efficiency of patch images of the respective component colors is set to be used per combined environmental condition. Specifically, a prescribed secondary transfer current value is previously stored again in an a memory (e.g., a RAM 303 shown in FIG. 2), which is capable of decreasing a difference in transfer efficiency of toner between component colors caused when patch images of the respective component colors are secondarily transferred onto the secondary transfer belt below a difference in transfer efficiency of toner between respective component colors caused when patch images of the respective component colors are secondarily transferred onto the secondary transfer belt under the same transfer condition as a toner image of superimposed multiple component colors is transferred onto a recording sheet. Otherwise, a prescribed correction coefficient, which is capable of calculating a targeted secondary transfer current value by multiplying the correction coefficient with an initially set secondary transfer current value, is previously stored again in the memory (a RAM 303 shown in FIG. 2). That is, as shown in FIG. 8, a temperature humidity sensor 308 installed in the main unit of the image forming apparatus 1 detects temperature and humidity (in step S201). Subsequently, either the secondary transfer current value or the correction coefficient corresponding to the detected temperature and humidity is read from the memory for the secondary transfer process of secondarily transferring the patch images of the respective component colors (in step S202). Multiple processes sequential executed thereafter from steps S203 to S206 are substantially the same as the processes sequential executed from steps S102 to S105 as the described earlier with reference to FIG. 6.

Hence, according to this modification, since the optimum secondary transfer condition is enabled to be set for the patch images of the respective component colors in accordance with the various combined environmental conditions, a difference in toner adhering amount between patch images of the respective component colors is decreased below a difference in toner adhering amount between patch images of the respective component colors caused when the patch images of the respective component colors are secondarily transferred onto the secondary transfer belt under the same transfer condition as a toner image of superimposed multiple component colors is transferred onto the recording sheet as in a conventional configuration. At the same time, the modification can also avoid various impacts of changes in environmental condition.

As described earlier, the patch images of the respective component colors are sometimes formed in an interval on the intermediate transfer belt between successively fed recording sheets. In such a situation, however, since a printing image has a multi-layer (i.e., a full-color), an optimum secondary transfer condition under which the multiple patch images of respective component colors are formed on (i.e., secondarily transferred onto) the secondary transfer belt within the interval between successively fed recording sheets is different from that under which the full-color toner image is formed (i.e., secondarily transferred onto the recording sheet) from each other. Accordingly, either the secondary transfer voltage or the secondary transfer current is switched to that for the patch images of the respective component colors. Such switching operation of switching from either the secondary transfer voltage or the secondary transfer current to that for the patch images of the respective component colors usually needs from about 50 [ms] to about 100 [ms]. In view of this, these multiple patch images of respective component colors are formed when about 50 [ms] to about 100 [ms] has elapsed after completion of printing of images to have a room to switch from a currently set secondary transfer condition for the image printing to another secondary transfer condition for forming the patch images. Similarly, when about 50 [ms] to about 100 [ms] has elapsed after completion of forming the patch images, the secondary transfer condition for forming the patch images is returned back to the secondary transfer condition for the image printing to execute the image printing. In this way, since a sufficient time for switching the respective secondary transfer conditions from one to another is ensured in the secondary transfer process of transferring patch images, the secondary transfer position can be located and set as described above (i.e., the interval on the intermediate transfer belt between successively fed recording sheets). With this, relative misalignment generally caused in the toner image composed of the superimposed multiple component colors can be reduced by correcting the image forming condition, such as a light exposing time, a driving speed profile, etc., while upgrading quality of a printed image at the same time as well.

In the above described various embodiments, although one example of the present invention is applied to the printer 1 that employs the tandem type intermediate transfer system with the intermediate transfer belt 101 as a belt type intermediate transfer member, the present invention is not limited to such a configuration, and can be also applied to a tandem type direct transfer image forming apparatus as well that employs a transfer conveyor belt as a belt type transfer unit, for example. Further, the present invention can be also applied to a different type of image forming apparatus that forms a monochrome image by using a transfer roller or the like as a transfer member as well.

The above-described various embodiments are just a few examples of the present invention, and are able to provide unique advantages per embodiment, respectively, as described herein below.

According to one aspect of the present invention, since respective patch images of the respective component colors are transferred onto the recording sheet conveyor under a secondary transfer condition set by a transfer condition setting system, a difference in transfer efficiency between color toner particles when patch images of respective component colors are secondarily transferred onto the secondary transfer belt becomes smaller than a difference in transfer efficiency between color toner particles caused when a toner image of superimposed multiple component colors is secondarily transferred onto the recording sheet. Accordingly, with this system, a difference in toner adhering amount between patch images of the respective component colors is decreased below a difference in toner adhering amount between the patch images of the respective component colors caused when the patch images of the respective component colors are secondarily transferred onto the secondary transfer belt under the same condition as the toner image of superimposed multiple component colors is secondarily transferred onto the recording sheet in the conventional system. Accordingly, when the difference in toner adhering amount between the patch images of the respective component colors is decreased, a difference in angle of rising or falling inclination between sensor outputs is also decreased correspondingly. As a result, fluctuations of times of outputs from the sensor detecting the multiple patch images of respective component colors are suppressed. Since positions of the patch images are detected based on times of outputs from the sensor, the positions of the patch images can be accurately detected accordingly. As a result, relative misalignment of superimposed multiple component colors of the toner image can be sufficiently reduced as well. That is, a novel image forming apparatus that includes; an image forming unit to form toner images of the multiple component colors and multiple patch images of respective component colors on an image bearer; a transfer unit to transfer and superimpose the toner images of the multiple component colors on a recording medium; and a recording medium conveyor to convey and bring the recording medium in contact with the image bearer in the transfer unit. The transfer unit also transfers the multiple patch images of respective component colors onto the recording medium conveyor. A patch image position sensor is provided to optically detect positions of the multiple patch images of respective component colors transferred from the image bearer by the transfer unit and borne on the recording medium conveyor. A correcting device is also provided to correct an image forming condition to reduce relative misalignment in the toner images of the multiple component colors based on times when the patch image position sensor outputs detection signals. A transfer condition setting device is provided to set a patch image transfer condition under which the multiple patch images of the respective component colors borne on the image bearer are transferred onto the recording medium conveyor. The transfer condition setting device sets a prescribed patch image transfer condition that decreases a difference in transfer efficiency of toner between the respective component colors caused when the multiple patch images of the respective component colors are transferred onto the recording medium conveyor below a difference in transfer efficiency of toner between the component colors caused when the multiple patch images of the respective component colors are transferred onto the recording medium conveyor under the same transfer condition as a toner image of superimposed multiple component colors is transferred onto the recording medium. According to another aspect of the present invention, fluctuations of times of outputs from the sensor detecting the multiple patch images of respective component colors are more effectively suppressed. That is, the prescribed patch image transfer condition is a prescribed value of transfer current flowing through the transfer unit when the transfer unit transfers the multiple patch images of the respective component colors from the image bearer onto the recording medium conveyor.

According to yet another aspect of the present invention, fluctuations of times of outputs from the sensor detecting the multiple patch images of respective component colors are more effectively suppressed. That is, the prescribed value of transfer current flowing through the transfer unit when the transfer unit transfers the multiple patch images of the respective component colors from the image bearer onto the recording medium conveyor maximizes transfer efficiency of toner of one of the respective component colors.

According to yet another aspect of the present invention, fluctuations of times of outputs from the sensor detecting the multiple patch images of respective component colors are more effectively suppressed. That is, the prescribed value of transfer current flowing through the transfer unit when the transfer unit transfers the multiple patch images of the respective component colors from the image bearer onto the recording medium conveyor maximizes transfer efficiency of toner of one of the respective component colors.

According to yet another aspect of the present invention, fluctuations of times of outputs from the sensor detecting the multiple patch images of respective component colors are more effectively suppressed. That is, the transfer efficiency increases an amount of toner uniformly adhering to each of the multiple patch images.

According to yet another aspect of the present invention, fluctuations of times of outputs from the sensor detecting the multiple patch images of respective component colors are more effectively suppressed. That is, an absolute value of the prescribed value of transfer current flowing through the transfer unit when the transfer unit transfers the multiple patch images of the respective component colors from the image bearer onto the recording medium conveyor is smaller than an absolute value that of a transfer current flowing through the transfer unit when the transfer unit transfers the multicolor toner image from the image bearer onto the recording medium.

According to yet another aspect of the present invention, fluctuations of times of outputs from the sensor detecting the multiple patch images of respective component colors are more effectively suppressed. That is, the prescribed value of transfer current flowing through the transfer unit when the transfer unit transfers the multicolor toner image from the image bearer onto the recording medium maximizes transfer efficiency of the multicolor toner.

According to yet another aspect of the present invention, fluctuations of times of outputs from the sensor detecting the multiple patch images of respective component colors are more effectively suppressed. That is, the prescribed patch image transfer condition is a prescribed amount of transfer voltage applied to the transfer unit when the transfer unit transfers the multiple patch images of the respective component colors from the image bearer onto the recording medium conveyor.

According to yet another aspect of the present invention, fluctuations of times of outputs from the sensor detecting the multiple patch images of respective component colors are more effectively suppressed. That is, the prescribed amount of transfer voltage applied to the transfer unit when the transfer unit transfers the multiple patch images of the respective component colors from the image bearer onto the recording medium conveyor maximizes transfer efficiency of toner of one of the respective component colors.

According to yet another aspect of the present invention, fluctuations of times of outputs from the sensor detecting the multiple patch images of respective component colors are more effectively suppressed. That is, a memory is provided to store both an optimum secondary transfer current value that maximizes secondary transfer efficiency per component color and a correction coefficient that obtains the optimum secondary transfer current value per component color by multiplying an initially set secondary transfer current value with it. The memory is referred to by the transfer condition setting device to set the patch image transfer condition. According to yet another aspect of the present invention, fluctuations of times of outputs from the sensor detecting the multiple patch images of respective component colors are more effectively suppressed. That is, a memory is provided to store both an optimum secondary transfer current value that maximizes secondary transfer efficiency per component color and an environment and a correction coefficient that obtains the optimum secondary transfer current value per component color and an environment by multiplying an initially set secondary transfer current value with it, the memory referred to by the transfer condition setting device to set the patch image transfer condition.

According to yet another aspect of the present invention, fluctuations of times of outputs from the sensor detecting the multiple patch images of respective component colors are more effectively suppressed. That is, the image forming unit includes, multiple photoconductors as image bearers, onto which the toner images of the multiple component colors and multiple patch images of the component colors are formed, respectively, and an intermediate transfer belt, onto which the toner images of the multiple component colors are primarily transferred and superimposed to form a multicolor toner image thereon and the multiple patch images of the respective component colors are primarily transferred one after another as are. The recording medium conveyor includes a secondary transfer belt to convey and bring the recording medium in contact with the intermediate transfer belt by forming a secondary transfer station therebetween. The recording medium conveyor receives the multiple patch images of the respective component colors transferred at the secondary transfer station one after another as are. The patch image position sensor is located facing a surface of the secondary transfer belt to optically detect positions of the multiple patch images of the respective component colors borne thereon.

According to yet another aspect of the present invention, fluctuations of times of outputs from the sensor detecting the multiple patch images of respective component colors are more effectively suppressed. That is, the intermediate transfer belt is made of rubber, and the secondary transfer belt is made of polyimide.

According to yet another aspect of the present invention, each of multiple patch images of respective component colors other than black has a relatively wider range of a transfer condition capable of obtaining a better transfer efficiency than a prescribed level. By contrast, the black patch image has a narrow range of the transfer condition capable of obtaining the better transfer efficiency than the prescribed level. In view of this, when a secondary transfer condition for patch images of the respective component colors other than a black patch image is set to be used for respective patch images of the respective component colors, transfer efficiency of the black patch image likely deteriorates depending on a degree of the secondary transfer condition. By contrast, when a secondary transfer condition that enables the black patch image to obtain the maximum transfer efficiency is set to be used for multiple patch images of respective component colors, a difference in transfer efficiency between multiple component color toner particles becomes smaller than a difference in transfer efficiency caused between multiple component color toner particles when a toner image of superimposed multiple component colors is secondarily transferred onto a recording sheet. As a result, a difference in toner adhering amount between the patch images of the respective component colors is decreased, and accordingly a difference in angle of rising or falling inclination between outputs from the sensor is also decreased as well. Accordingly, fluctuations of output times from the sensor that detects patch images of respective component colors are suppressed. Since positions of the patch images are detected based on the output times from the sensor, the positions of the patch images can be more accurately detected accordingly. As a result, relative misalignment of superimposed multiple component colors of the toner image can be more sufficiently reduced. That is, the transfer condition setting device sets a patch image transfer condition under which a black patch image is transferred onto the recording medium, as the transfer condition under which all of the patch images of respective component colors are transferred onto the recording medium conveyor.

According to yet another aspect of the present invention, since a transfer condition generally preferably set to be used when a line image is transferred onto a recording sheet is also preferable when a shape of an edge of each of the patch images of the respective component colors is expected to be precisely reproduced. Hence, by setting such a transfer condition preferable for the line image is similarly set as a secondary transfer condition when the multiple patch images of respective component colors are secondarily transferred onto the recording sheet conveyor. Accordingly, a reproducing ability of reproducing the shapes of edges of the patch images of respective component colors are upgraded. Accordingly, since this may upgrade accuracy of output times of the sensor which detects the multiple patch images, fluctuations in sensor outputs are more effectively reduced. With this, respective positions of the patch images of the respective component colors can be more accurately detected. As a result, relative misalignment of the toner image of superimposed multiple component colors can be more sufficiently reduced. That is, the transfer condition setting device sets a transfer condition under which a line image is transferred onto the recording medium as the patch image transfer condition under which the patch images of respective component colors are transferred onto the recording medium conveyor.

According to yet another aspect of the present invention, since the best transfer condition for the patch images of the respective component colors is set to be used in accordance with an environmental condition, preferable secondary transfer performance of secondarily transferring the patch images of the respective component colors can be obtained while avoiding an impact of a change in environmental condition. At the same time, fluctuations in outputs from a sensor generated when the sensor detects respective positions of the patch images of the respective component colors transferred and borne on the recording sheet conveyor can be more effectively reduced. As a result, relative misalignment of the toner image of superimposed multiple component colors can be more sufficiently reduced again. That is, the transfer condition setting device changes the patch image transfer condition under which the patch images of respective component colors are transferred onto the recording medium conveyor, in accordance with the environment.

According to yet another aspect of the present invention, more preferable secondary transfer performance of secondarily transferring the patch images of the respective component colors can be obtained while avoiding an impact of a change in environmental condition. That is, the recording medium conveyor has absorbency and the environment includes humidity. The prescribed transfer condition is a prescribed value of transfer current flowing through the transfer unit when the transfer unit transfers the multiple patch images of the respective component colors from the image bearer onto the recording medium conveyor. The value of transfer current is decreased when the humidity increases.

According to yet another aspect of the present invention, since a time period for switching a secondary transfer condition is highly likely ensured, relative misalignment of superimposed multiple component colors of the toner image can be sufficiently reduced by using an interval between successively fed recording sheets. At the same time, since an image forming condition, such as a light exposing time, a driving speed profile, etc., is corrected and adjusted, relative misalignment possibly caused in the superimposed multiple component colors of the toner image can be readily reduced, while upgrading quality of a printing image as well. That is, the patch image transfer condition setting device sets a patch image transfer condition under which the patch images of respective component colors borne on the image bearer is transferred onto the recording medium conveyor in synchronism with an interval between successively fed recording media during an image printing process. The transfer condition setting device thereafter sets a multicolor toner image transfer condition under which a multicolor toner image is transferred onto the recording medium.

Numerous additional modifications and variations of the present invention are possible in light of the above teachings. It is therefore to be understood that within the scope of the appended claims, the present invention may be executed otherwise than as specifically described herein. For example, the image forming apparatus is not limited to the above-described various embodiments and modifications and may be altered as appropriate. Further, the method of forming an image is not limited to the above-described various embodiments and may be altered as appropriate. For example, steps of the method of forming an image can be altered as appropriate.

What is claimed is:

1. An image forming apparatus comprising:

an image forming unit including an image bearer to form a multicolor toner image by superimposing multiple toner images of respective component colors and multiple patch images of the respective component colors on the image bearer;

a transfer unit to transfer the multicolor toner image from the image bearer onto a recording medium;

a recording medium conveyor to convey and bring the recording medium in contact with the image bearer in the transfer unit, the transfer unit transferring the multiple patch images of respective component colors from the image bearer onto the recording medium conveyor;

a patch image position sensor to detect positions of the multiple patch images of the respective component colors transferred from the image bearer by the transfer unit and borne on the recording medium conveyor;

a correcting device to correct an image forming condition to reduce relative misalignment in the multiple toner images of the respective component colors based on times when the patch image position sensor outputs detection signals of the positions of the multiple patch images;

a transfer condition setting device to set a patch image transfer condition under which the multiple patch images of the respective component colors borne on the image bearer are transferred onto the recording medium conveyor, the transfer condition setting device setting a multicolor toner image transfer condition under which the multicolor toner image borne on the image bearer is transferred onto the recording medium; and a memory to store at least one of an optimum secondary transfer current value that maximizes secondary transfer efficiency of toner per component color and a correction coefficient used to calculate the optimum secondary transfer current value per component color by multiplying the correction coefficient with an initially set secondary transfer current value under which the multicolor toner image is transferred from the image bearer onto the recording medium, wherein the transfer condition setting device sets a prescribed patch image transfer condition capable of decreasing a difference in transfer efficiency of toner between respective component colors when the multiple patch images of the respective component colors are transferred onto the recording medium conveyor below a difference in transfer efficiency of toner between the respective component colors caused when the multicolor toner image is transferred from the image bearer onto the recording medium.

2. The image forming apparatus as claimed in claim 1, wherein the prescribed patch image transfer condition is a prescribed value of transfer current flowing through the transfer unit when the transfer unit transfers the multiple patch images of the respective component colors from the image bearer onto the recording medium conveyor.

3. The image forming apparatus as claimed in claim 2, wherein the prescribed value of transfer current maximizes transfer efficiency of toner of one of the respective component colors, wherein the transfer efficiency increases an amount of toner adhering to each of the multiple patch images of the respective component colors.

4. The image forming apparatus as claimed in claim 3, wherein the transfer efficiency increases an amount of toner uniformly adhering to each of the multiple patch images of the respective component colors.

5. The image forming apparatus as claimed in claim 2, wherein an absolute value of the prescribed value of transfer current is smaller than an absolute value of a transfer current flowing through the transfer unit when the transfer unit transfers the multicolor toner image from the image bearer onto the recording medium.

6. The image forming apparatus as claimed in claim 1, wherein the multicolor toner image transfer condition is a prescribed value of transfer current flowing through the transfer unit when the transfer unit transfers the multicolor or toner image from the image bearer onto the recording medium, the prescribed value maximizing transfer efficiency of multicolor toner of the multicolor toner image as a whole.

7. The image forming apparatus as claimed in claim 1, wherein the prescribed patch image transfer condition is a prescribed amount of transfer voltage applied to the transfer unit when the transfer unit transfers the multiple patch images of the respective component colors from the image bearer onto the recording medium conveyor.

8. The image forming apparatus as claimed in claim 7, wherein the prescribed amount of transfer voltage maximizes transfer efficiency of toner of one of the respective component colors.

9. The image forming apparatus as claimed in claim 1, wherein the memory referred to by the transfer condition setting device to set the patch image transfer condition when the multiple patch images of the respective component colors are formed.

10. The image forming apparatus as claimed in claim 1, wherein the memory stores at least one of the optimum secondary transfer current value that maximizes secondary transfer efficiency of toner in accordance with an environment per component color and the correction coefficient that calculates the optimum secondary transfer current value in accordance with an environment per component color by multiplying the correction coefficient with the initially set secondary transfer current value under which the multicolor toner image is transferred from the image bearer onto the recording medium, the memory referred to by the transfer condition setting device to set an applicable optimum secondary transfer current value as the patch image transfer condition when the multiple patch images of the respective component colors are formed.

11. The image forming apparatus as claimed in claim 1, wherein the image forming unit includes, multiple photoconductors acting as the image bearers, onto which the multiple toner images of the respective component colors of the multicolor toner image and the multiple patch images of the respective component colors are formed, and an intermediate transfer belt onto which the multiple toner images of the respective component colors are primarily transferred and superimposed to form a multicolor toner image thereon and the multiple patch images of the respective component colors are primarily transferred one after another as are, wherein the recording medium conveyor includes a secondary transfer belt to convey and bring the recording medium in contact with the intermediate transfer belt by forming a secondary transfer station therebetween, the recording medium conveyor receiving the multiple patch images of the respective component colors transferred at the secondary transfer station one after another as are, wherein the patch image position sensor is located facing a surface of the secondary transfer belt to detect positions of the multiple patch images of the respective component colors borne on the secondary transfer belt.

12. The image forming apparatus as claimed in claim 11, wherein the intermediate transfer belt is made of rubber and the secondary transfer belt is made of polyimide.

13. The image forming apparatus as claimed in claim 1, wherein the transfer condition setting device sets, as the patch image transfer condition, a transfer condition that maximizes transfer efficiency of black toner when a black patch image is transferred onto the recording medium conveyor.

14. The image forming apparatus as claimed in claim 1, wherein the transfer condition setting device sets, as the patch image transfer condition, a transfer condition that maximizes transfer efficiency of toner forming a line image when the line image is transferred onto the recording medium.

15. The image forming apparatus as claimed in claim 1, wherein the transfer condition setting device changes the patch image transfer condition in accordance with an environment.

16. The image forming apparatus as claimed in claim 15, wherein the recording medium conveyor has absorbency and the environment includes humidity, wherein the patch image transfer condition is a prescribed value of transfer current flowing through the transfer unit when the transfer unit transfers the multiple patch images of the respective component colors from the image bearer onto the recording medium conveyor, wherein the transfer condition setting device sets a decreased value of transfer current as humidity increases.

17. The image forming apparatus as claimed in claim 1, wherein the transfer condition setting device sets the prescribed patch image transfer condition in synchrony with an interval on a surface of the image hearer between successively fed recording media during an image printing process, and then sets the multicolor toner image transfer condition.

18. A method of forming a multicolor toner image, comprising the steps of:

forming a multicolor for toner image by superimposing multiple toner images of respective component colors on an image bearer with an image forming unit;

conveying and bringing a recording medium in contact with the image bearer with a recording medium conveyor;

transferring the multicolor toner image from the image bearer onto a recording medium with a transfer unit;

forming multiple patch images of respective component colors on the image bearer with the image forming unit;

storing in memory at least one of an optimum secondary transfer current value that maximizes secondary transfer efficiency of toner per component color and a correction coefficient used to calculate the optimum secondary transfer current value per component color by multiplying the correction coefficient with an initially set secondary transfer current value under which the multicolor toner image is transferred from the image bearer onto the recording medium;

setting, with a transfer, condition setting device, a patch image transfer condition capable of decreasing a difference in transfer efficiency of toner between the respective component colors of the multiple patch images when the multiple patch images of the respective component colors are transferred onto the recording medium conveyor below a difference in transfer efficiency of toner between the respective component colors of the multiple patch images caused when a multicolor for toner image is transferred onto the recording medium;

transferring the multiple patch images of the respective component colors onto the recording medium conveyor with the transfer unit under the patch image transfer condition;

detecting positions of the multiple patch images of the respective component colors transferred from the image bearer by the transfer unit and borne on the recording medium conveyor with a patch image position sensor; and correcting an image forming condition with a correcting device to reduce an amount of relative misalignment caused in the multiple toner images of the respective component colors based on times when the patch image position sensor outputs detection signals of the positions of the multiple patch images.

* * * * *